US005553748A

United States Patent [19]

Battle

[11] Patent Number: 5,553,748

[45] Date of Patent: Sep. 10, 1996

[54] REFILLABLE LIQUID DISPENSER

[76] Inventor: John R. Battle, 11306 W. Pool Ct., Crystal River, Citrus County, Fla. 32629

[21] Appl. No.: 562,797

[22] Filed: Nov. 27, 1995

Related U.S. Application Data

[63] Continuation of Ser. No. 266,017, Jun. 27, 1994, abandoned, which is a continuation of Ser. No. 982,449, Nov. 27, 1992, Pat. No. 5,328,055.

[51] Int. Cl.[6] ..... B65D 35/22

[52] U.S. Cl. ..... 222/94; 222/83.5; 222/105; 222/325

[58] Field of Search ..... 222/80, 81, 82, 222/83, 83.5, 88, 91, 92, 94, 105, 325, 340, 416

[56] References Cited

U.S. PATENT DOCUMENTS

| | | | |
|---|---|---|---|
| 3,655,096 | 4/1972 | Easter | 222/82 |
| 3,995,773 | 12/1976 | Schmit | 222/91 |
| 4,098,434 | 7/1978 | Uhlig | 222/105 X |
| 4,163,509 | 8/1979 | Amneus | 222/105 X |
| 4,168,032 | 9/1979 | Sneider | 222/105 X |
| 4,602,725 | 7/1986 | Malpas et al. | 222/83.5 |
| 4,759,473 | 7/1988 | Derby et al. | 222/105 |
| 4,869,398 | 9/1989 | Colvin et al. | 222/83 |
| 5,031,798 | 7/1991 | Wild | 222/82 |
| 5,114,004 | 5/1992 | Isono et al. | 222/94 X |
| 5,143,294 | 9/1992 | Lintvedt | 222/105 X |

*Primary Examiner*—Joseph A. Kaufman
*Attorney, Agent, or Firm*—A. W. Fisher, III

[57] ABSTRACT

A refillable liquid dispenser or container comprising an outer rigid hollow housing including an upper neck having an opening formed therein to receive a liquid dispensing assembly therein and a replaceable inner pliant liquid bladder including an upper portion disposed within the upper neck and a lower portion disposed within the outer rigid hollow housing to receive the lower portion of the liquid dispensing assembly therein.

18 Claims, 5 Drawing Sheets

REFILLABLE LIQUID DISPENSER

CO-PENDING APPLICATION

This application is a continuation application of application Ser. No. 08/266,017, filed Jul. 27, 1994 now abandoned which is a continuation application Ser. No. 07/982,449 filed Nov. 27, 1992 of U.S. 5,328,055 issued Jul. 12, 1994.

BACKGROUND OF THE INVENTION

1. Field of the Invention

A refillable liquid dispenser or container comprising an outer rigid hollow housing and a replaceable inner pliant liquid bladder.

2. Description of the Prior Art

Numerous spraying devices and liquid containers have been developed. The receptacles are generally formed as a closed container filled with take liquid to be sprayed through a fill opening formed in a neck with a spray head screwed onto the neck.

Unfortunately refilling of such spraying devices and liquid containers commonly has several disadvantages. For example, there is the risk of spilling or overfilling of the liquid during the filling or refilling operation.

U.S. Pat. No. 5,143,294 describes a container for a liquid paint or insecticide product from which the liquid can be applied by a conventional liquid spray device. The container is sealed except for an opening at or near one end having a conventional spray device attached thereto. The dip tube or siphon tube from the spray device is inserted through the opening and sealed by means of a plug through which the dip or siphon tube is inserted. The container with the liquid is then placed into the liquid holding canister. The spray device is then operated to dispense the liquid through the spray nozzle.

U.S. Pat. No. 5,118,003 shows a disposable cover and bag assembly comprising an outer cover member adapted to be connected to the open end of an outer canister and having a top including an opening, an inner cover member in the opening in the top of the outer cover member and a bag having a mouth gripped between the inner and outer cover members.

U.S. Pat. Nos. 5,056,685 and 5,031,798 teach a spraying device comprising a receptacle for the fluid to be sprayed and a spray head disposed on the receptacle to dispense or spray the fluid. The receptacle comprises a refill pouch for receiving the fluid and a holding means for detachably holding the refill pouch. The spray head is mounted on the holding means and connected to the interior of the refill pouch through a connection means.

U.S. Pat. No. 4,168,032 describes an expandable syringe comprising a bag having an opening through which liquid may pass. A closed end tubular valve stem projects outwardly from the bag opening and has an orifice in the side thereof in fluid communication with the interior of the bag. A nozzle has a female coupler sized to be movably mounted about the valve stem. The nozzle coupler has a valve seat against which the valve stem closed end may operationally engage in controlling the flow of liquid between the bag and nozzle.

U.S. Pat. No. 3,411,503 shows a syringe for medical use comprising a bellows-type collapsible body containing a diluent and disposed in a case on which a hypodermic needle may be mounted in communication with the body to puncture an enclosing membrane.

U.S. Pat. No. Re. 24,918 discloses a pliant container for containing and dispensing low boiling liquids therefrom.

U.S. Pat. No. 3,203,484 teaches a portable fire extinguishing device utilizing a pliant container from which foam is discharged by means of winding the container upon itself for mixing and dispensing the foam therefrom.

U.S. Pat. No. 3,255,972 shows a pliable container for use with a sprayer generally of the type adapted to be connected to a hose for watering lawns or flowers or the like. In particular, the sprayer has a chemical to be mixed with water contained in a disposble collapsible container or cartridge having an aspiring tube extending into the water stream and further containing means for applying the stream of water pressure to the outer surfaces of the collapsible container to force the liquid chemical through the aspiring tube into the water stream. This device requires the normally rigid container of the spray device as well as a separate rigid container with apertures through its walls positioned within the normal rigid container of the spray device for filling with water for dispensing the chemical from the flexible container.

Additional examples of the prior art are shown in U.S. Pat. Nos. 1,950,155 and 2,944,706.

U.S. Pat. No. 3,655,096 describes a container for diluting and dispensing materials in liquid form that consists of a primary vessel, a bottle, adapted to contain a dilutant such as water and a replaceable cartridge mounted removably in the mouth of the bottle. The cartridge including a laterally projecting circular flange which lies in contact with the edge of the bottle mouth contains a relatively small amount of a chemical concentrate that is to be diluted. A dispensing mechanism composed of a pump with a bottle cap at its lower end is used to withdraw the contents of the container. A dip tube that extends downwards from the cap is introduced into the bottle through the cartridge thereby perforating the same and in this way allowing the chemical material in the cartridge to drain into the primary container. The cap is then screwed onto the neck of the bottle. When empty, the cartridges are thrown away and replaced.

U.S. Pat. No. 3,995,773 shows a flexible liquid container and dispensing device including a flexible fluid containing pouch with a rigid tubular member therein held in position by a sleeve member. The sleeve member is mounted on a pouring structure movable relative to the pouch and the tubular member therein for piercing the same to dispense fluid from the pouch. The pouring structure provides not only a spout for dispensing of the fluid but also a suitable closure for recapping the pouch after usage to retain the balance of the fluid therein.

U.S. Pat. No. 4,098,434 teaches a fluid product dispenser including first container with a second container disposed therein. The product is placed in one of the containers with a dispensing nozzle or opening is in communication with the product. The second container has a flexible wall adjacent the product. Force applied to the flexible wall urges the product outwardly through the dispensing nozzle or opening.

U.S. Pat. No. 4,163,509 describes a dispensing container having a spout formed of opposing walls of supple, imperforate material joined along their side edges with at least a portion thereof being formed over a curved surface. The spout is set in a curled condition in the direction of discharge with the walls in face-to-face contact to effect a valving action. The spout can include a metering chamber to permit a desired quantity of fluid contents to be separated and milked through the curled portion to the discharge end of the spout. If desired, the entire dispensing container can be similarly formed over a curved surface so that the empty end of the container opposite the spout will also assume a curled conformation as the container's contents are discharged through the spout.

U.S. Pat. No. 4,602,725 shows a tap for a "bag-in-the-box" container including a body having a cylindrical wall extending interiorly and exteriorly of the container having a beveled end across which a diaphragm is mounted. A spigot having a cylindrical wall part rotatably mounted within the body cylindrical wall portion also has a beveled end whereby rotation of the spigot within the body removes the diaphragm and brings openings in the body and spigot into alignment for liquid discharge.

U.S. Pat. No. 4,759,473 teaches a collapsible receptacle for handling flowable materials in semi-bulk quantities including an integral sling structure. The receptacle comprises side panels, a top panel including a fill spout and a bottom panel. Lift sleeves are formed in opposing side panels for supporting the receptacle without an external sling arrangement or pallet. The receptacle may include bands of continuous filaments woven into two side panels for additional strength.

U.S. Pat. No. 4,869,398 describes a liquid container packaged in a box having a removable handle which also acts as a closure device for the opening and closing of the box. The container comprises an inner bladder wrapped in a carbon dioxide/oxygen gas barrier. The gas barrier reduces or prevents the deterioration of the liquid in the inner bladder. The inner bladder has three ports for accessing the liquid. These ports are of a septum-type which can indicate tapering. The inner bladder also has a fill tube for use in filling, and a metal hook for hanging if the inner bladder is removed from the box. The box also has perforated cutouts to allow viewing of the liquid and to provide access to the ports of the inner bladder stored in the box.

U.S. Pat. No. 5,031,798 shows a spraying device comprising a receptacle for the fluid to be sprayed and a spray head disposed on the receptacle for spraying the fluid wherein the receptacle comprises a refill pouch for receiving the fluid and a holding means for detachably holding the refill pouch and wherein the spray head is mounted on the holding means and connected to the interior of the refill pouch through a connection means.

U.S. Pat. No. 5,114,004 describes a mixing container including compartments which are isolated from each other. Plural substances which contain components susceptible to mutual reaction unless isolated from each other are contained in the respective compartments. In use, these compartments are communicated together so that the individual contents can be mixed within the container. A flow passage or passages, each of which has an isolator for the contents is adapted to communicate the compartments with each other, and is formed by a side channel provided on an outer surface of a wall of the container. Mixing of the contents without exposure to the external atmosphere can be realized by irreversible destruction of the isolator upon use.

SUMMARY OF THE INVENTION

The present invention relates to a refillable liquid dispenser or container comprising an outer rigid hollow housing including an externally threaded upper neck to receive a liquid dispensing assembly therethrough and a replaceable inner pliant liquid bladder disposed within the outer rigid hollow housing to receive the lower portion of the liquid dispensing assembly therein.

The outer rigid hollow housing includes an upper opening formed in the upper portion thereof to facilitate the installation or placement of the replaceable inner pliant liquid bladder therein and a lower opening formed in the bottom or base thereof to receive the replaceable inner pliant liquid bladder therethrough.

The replaceable inner pliant liquid bladder comprises an upper bladder portion that Joins a lower bladder portion. An installation means may be coupled to the replaceable inner pliant liquid bladder to aid in the installation or placement of the replaceable inner pliant liquid bladder in the outer rigid hollow housing.

The replaceable inner pliant liquid bladder is placed through the lower opening into the interior of the outer rigid hollow housing. The upper bladder portion and installation means may be grasped through the upper opening and guided through the externally threaded upper neck. The upper bladder portion is then pushed downward partially into the externally threaded upper neck. The edges are folded over the externally threaded upper neck and held against the externally threaded upper neck with the thumb and forefinger. The liquid dispensing assembly is forced through the bottom of the upper bladder portion into the replaceable inner pliant liquid bladder. An internally threaded cap is then secured to the externally threaded upper neck such that the replaceable inner pliant liquid bladder is held in place therebetween.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
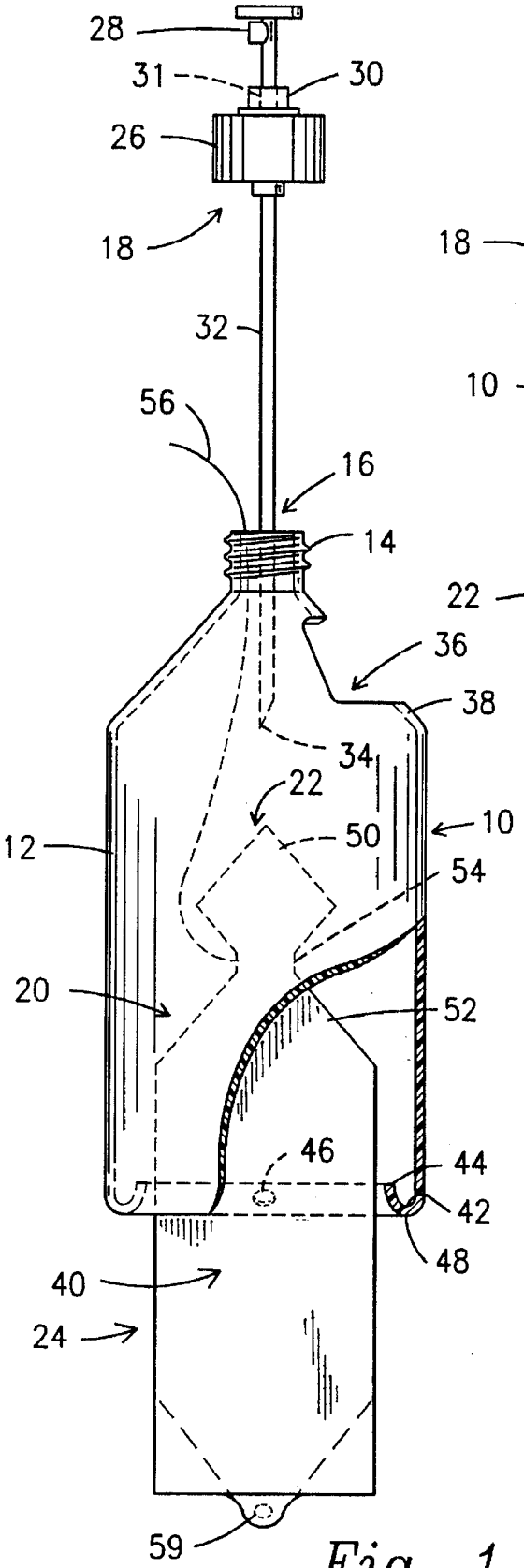
FIG. 1 is an exploded side view of the refillable liquid bladder.
Figure 2:
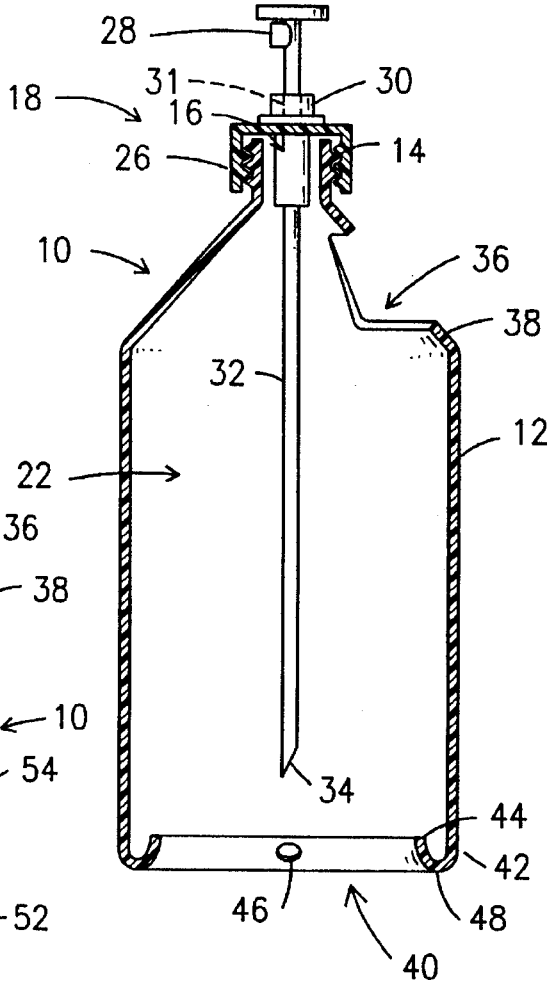
FIG. 2 is a cross-sectional side view of the outer rigid hollow housing.

As shown in FIGS. 1 and 2, the present invention relates to a refillable liquid dispenser or container generally indicated as 10 comprising an outer rigid hollow housing 12 including an externally threaded upper neck 14 having an opening 16 formed therein to receive a liquid dispensing assembly generally indicated as 18 therein and a replaceable inner pliant liquid bladder generally indicated as 20 including an upper bladder portion generally indicated as 22 disposed within the externally threaded upper neck 14 and a lower bladder portion generally indicated as 24 disposed within the outer rigid hollow housing 12 to receive the lower portion of the liquid dispensing-assembly 18 therein.

As shown in FIGS. 1 and 2, the liquid dispensing assembly 18 comprises an internally threaded cap 26 to secure the liquid dispensing assembly 18 to externally threaded upper neck 14, a spray nozzle 26, a spray-pump cap 30 including an aperture 31 and a lower liquid dip or siphon tube 32 having an inclined or pointed distal end 34 to puncture the upper bladder portion 22 of the replaceable inner pliant liquid bladder 20 when installed or placed within the externally threaded neck 14 as described more fully hereinafter.

As shown in FIGS. 1 and 2, the outer rigid hollow housing 12 includes an upper opening 36 formed in the upper side wall 38 of the outer rigid hollow housing 12 to facilitate the installation or placement of the replaceable inner pliant liquid bladder 20 in the outer rigid hollow housing 12 as described more fully hereinafter and a lower opening 40 formed in the bottom or base 42 of the outer rigid hollow housing 12 to receive the replaceable inner pliant periphery 48 of the lower opening 40.

Figure 3:
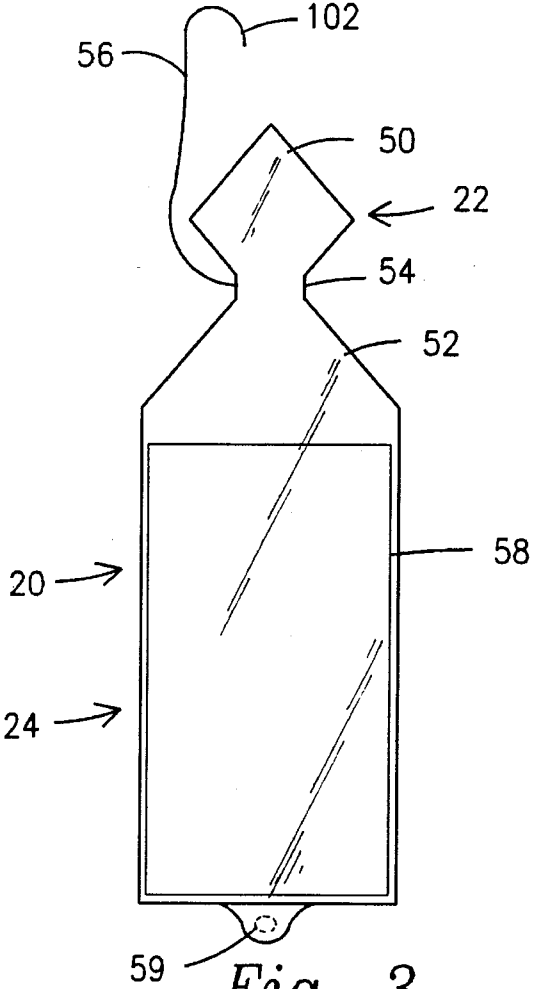
FIG. 3 is a side view of the replaceable inner pliant liquid bladder.

As best shown in FIG. 3, the upper bladder portion 22 of the replaceable inner pliant liquid bladder 20 comprises a flexible diamond shaped upper end 50 that intersects a reduced upper end 52 of the lower bladder portion 24 of the replaceable inner pliant liquid bladder 20 as at 54. An installation means such as a rigid member 56 (FIG. 3) or flexible element 57 (FIG. 4) may be coupled to the replaceable inner pliant liquid bladder 20 to aid in the installation or placement of the replaceable inner pliant liquid bladder 20 in the outer rigid hollow housing 12. A secondary bladder 58 to retain the liquid therein may be disposed within the replaceable inner pliant liquid bladder 20. An aperture 59 may be formed on the lower end of the lower bladder portion 24 to receive the button or hook 46 to retain the lower bladder portion 24 within the outer rigid hollowing housing 12 as the liquid is depleted from the replaceable inner pliant liquid bladder 20 or secondary bladder 58.

Figure 5:
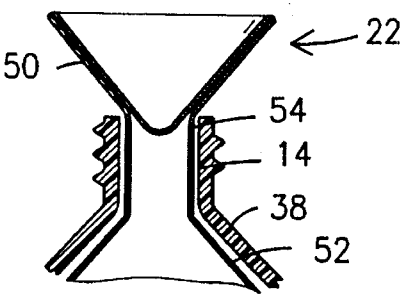
FIGS. 4 through 7 show partial side views of the replaceable inner pliant liquid bladder in various stages of installation in the outer rigid hollow housing.
Figure 7:
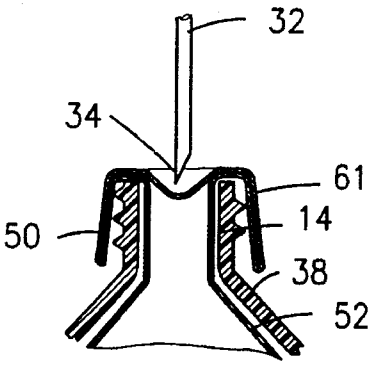
Figure 4:
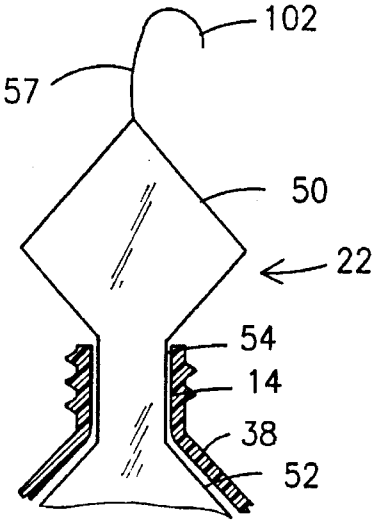
Figure 6:
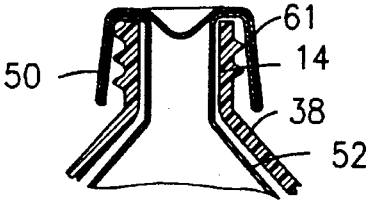

Installation or placement of the replaceable inner pliant liquid bladder 20 is best understood with reference to FIGS. 1 through 7. Specifically, the replaceable inner pliant liquid bladder 20 is placed through the lower opening 40 into the interior of the outer rigid hollowing housing 12. The upper bladder portion 22, rigid member 56 or flexible element 57 may be grasped through the upper opening 36 and guided through the opening 16 of the externally threaded upper neck 14 (FIG. 4). The upper bladder portion 22 is then pushed downwards partially into the opening 16 to form a funnel shaped configuration (FIG. 5). The edges 61 are folded over the externally threaded upper neck 14 and held against the externally threaded upper neck 14 with the thumb and forefinger. The inclined or pointed distal end 34 pierces the bottom of the funnel as the lower liquid dip or siphon tube 32 is moved downward into the replaceable inner pliant liquid bladder 20. The internally threaded cap 26 is then secured to the external threaded upper neck 14 such that the replaceable inner pliant liquid bladder 20 is held in place therebetween.

Figure 8:
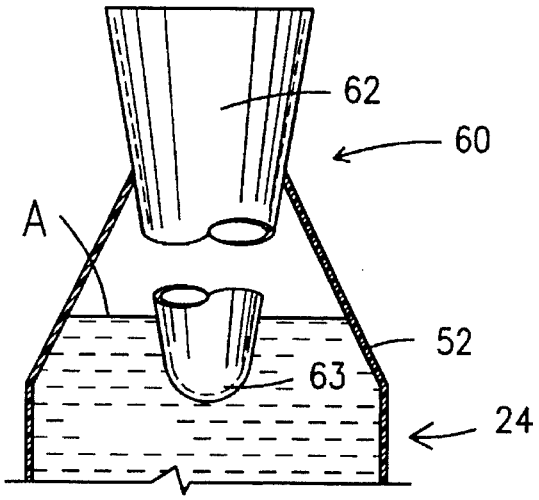
FIG. 8 is a partial side view of alternate embodiment of the replaceable inner pliant liquid bladder.

FIG. 8 shows an alternate embodiment of the replaceable inner pliant liquid bladder 20. Specifically, the upper bladder portion generally indicated as 60 of the replaceable inner pliant liquid bladder 20 comprises a flexible open funnel or cone-shaped upper end 62 extending into the reduced upper end 52 of the lower bladder portion 24 of the replaceable inner pliant liquid bladder 20. Installation or placement in the outer rigid hollow housing 12 is similar to the procedure of the embodiment shown in FIGS. 4 through 7 except that the pressure created by the liquid A acts to seal the lower end 63 of the flexible open funnel or cone-shaped upper end 62 as the lower liquid dip or siphon tube 32 is forced therethrough.

Figure 9:
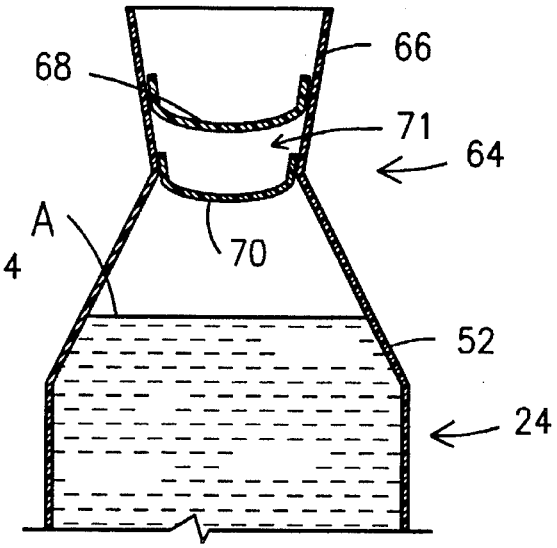
FIG. 9 is a partial side view of another alternate embodiment of the replaceable inner pliant liquid bladder.

FIG. 9 shows another alternate embodiment of the replaceable inner pliant liquid bladder 20. Specifically, the upper bladder portion 64 of the replaceable inner pliant liquid bladder 20 comprises a flexible upper end 66 including a first and second barrier indicated as 68 and 70 respectively cooperatively forming a liquid isolation chamber 71 therebetween that intersects the reduced upper portion 52 of the lower bladder portion 24 of the replaceable inner pliant liquid bladder 20. Installation or placement is similar to the procedure of the embodiment shown in FIGS. 4 through 7.

Figure 10:
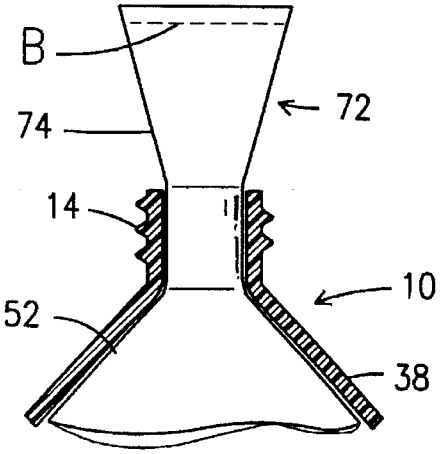
FIGS. 10 through 12 show yet another alternate embodiment of the replaceable inner pliant liquid bladder.
Figure 11:
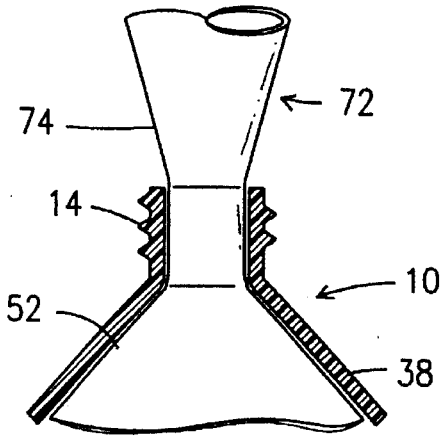
Figure 12:
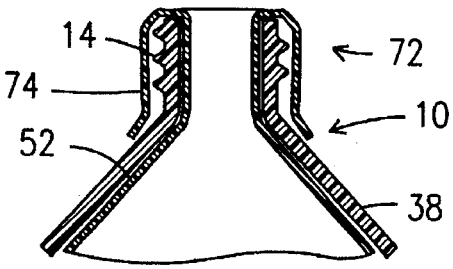

FIGS. 10 through 12 show yet another alternate embodiment of the replaceable inner pliant liquid bladder 20. Specifically, the upper bladder portion 72 of the replaceable inner pliant liquid bladder 20 comprises a flexible closed funnel shaped upper end 74 that intersects the reduced upper end 52 of the lower bladder portion 24 of the replaceable inner pliant liquid bladder 20. Installation or placement is similar to the procedure of the embodiment shown in FIGS. 4 through 7 except the top of the flexible closed funnel shaped upper end 74 is cut along line B.

Figure 13:
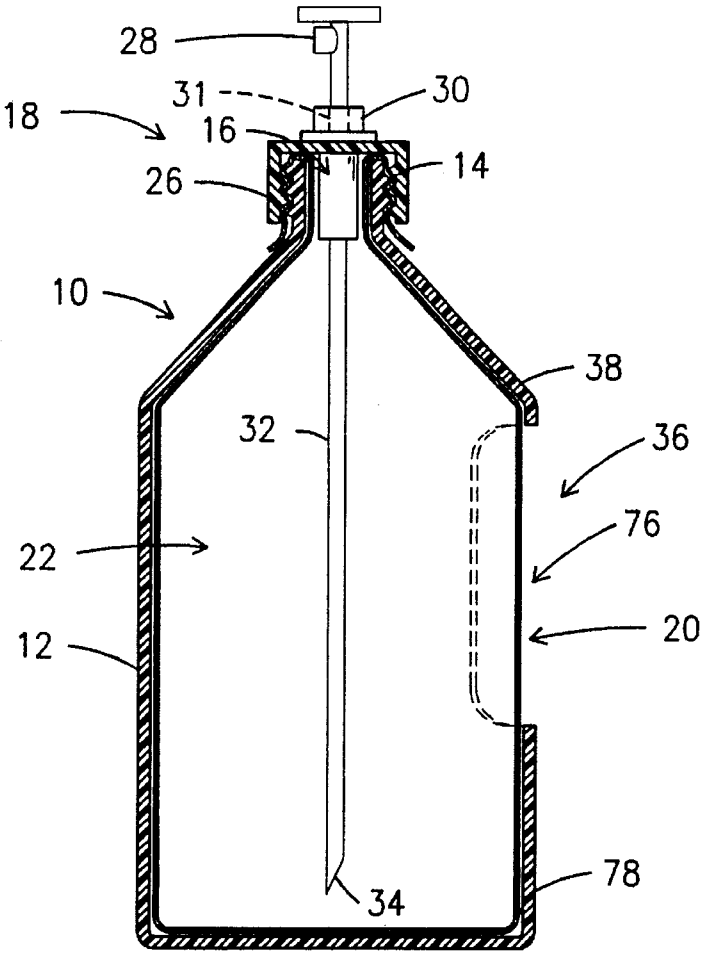
FIG. 13 is a cross-sectional side view of an alternate embodiment of the outer rigid hollow housing.
Figure 18:
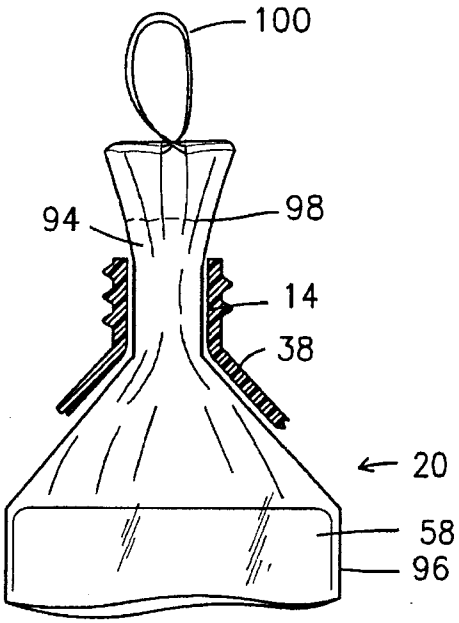
FIGS. 16 through 19 show still another alternate embodiment of the replaceable inner pliant liquid bladder.
Figure 19:
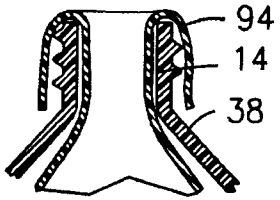
Figure 17:
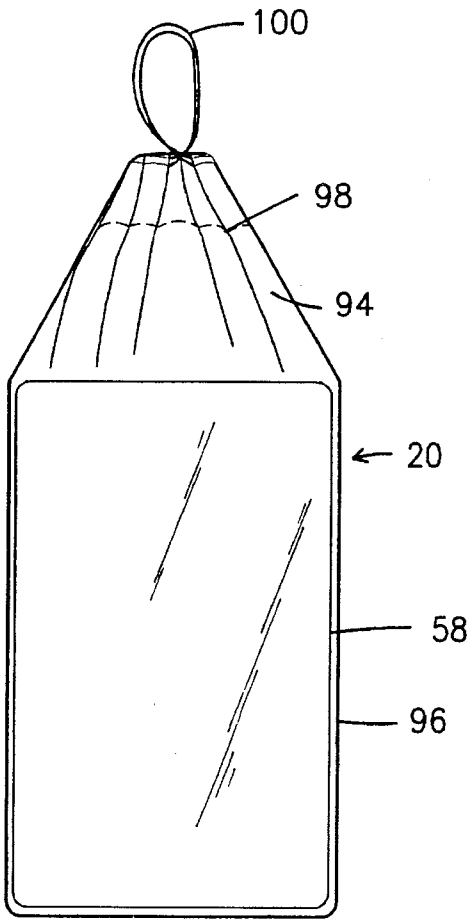
Figure 16:
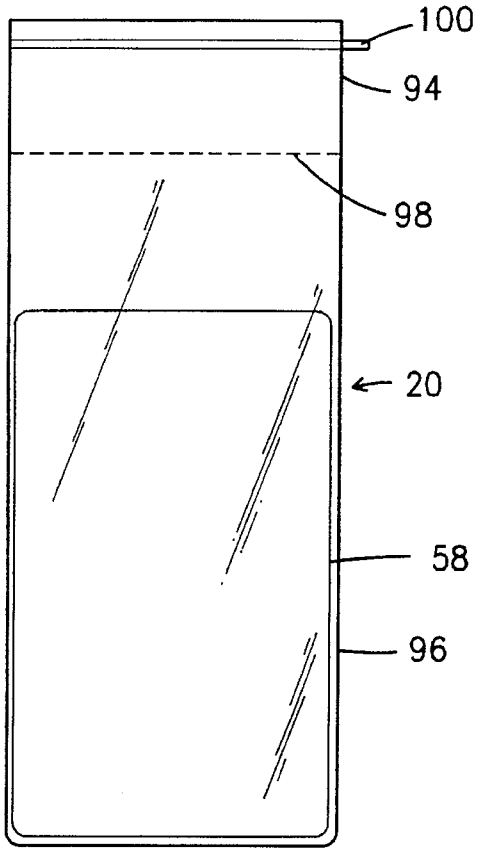

FIG. 13 shows an alternate embodiment of the outer rigid hollow housing 12 including a side opening 76 formed in the side wall 78 of the outer rigid hollow housing 12 to install or place the replaceable inner pliant liquid bladder 20 in the outer rigid hollow housing 12.

Figure 14:
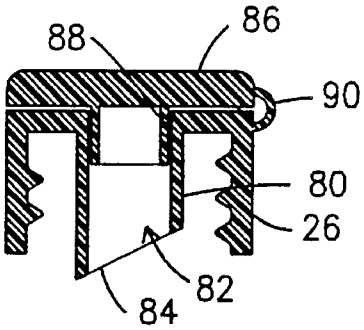
FIG. 14 is a cross-sectional side view of an alternate embodiment of the cap.
Figure 15:
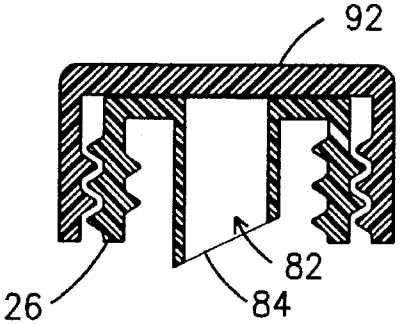
FIG. 15 is a cross-sectional side view of another alternate embodiment of the cap.

FIGS. 14 and 15 show alternate embodiments of the internally threaded cap 26. Specifically, as shown in FIG. 14, the internally threaded cap 26 further includes an inner concentrically aligned apron 80 forming a channel 82 having an inclined or distal end 84 formed thereon and a top 86 including a stopper 88 hingedly attached thereto by a hinge 90 to permit selective closure of the channel 82. The internally threaded cap 26 of FIG. 15 similarly includes the inner concentrically aligned apron 80 forming the channel 82 having the inclined or distal end 84 formed thereon. In addition, the outer surface of the internally threaded cap 26 is externally threaded to receive an internally threaded top 92 to permit selective closure of the channel 82.

FIGS. 16 through 19 show still another alternate embodiment of the replaceable inner pliant liquid bladder 20. Specifically, the replaceable inner pliant liquid bladder 20 comprises a flexible rectilinear upper bladder portion 94 and a lower bladder portion 96 of the replaceable inner pliant liquid bladder 20 with the secondary bladder 58 disposed therein. Installation or placement is similar to the procedure of the embodiment shown in FIGS. 4 through 7 except the top of the flexible rectilinear bladder portion 94 is torn along a perforation line 98. An attachment means such as a draw string 100 may be attached to the flexible rectilinear upper bladder portion 94 to mount the replaceable inner pliant liquid bladder 20 for display. Alternately, the attachment means may comprise a hook 102 as shown in FIGS. 3 and 4. This hook 102 allows the purchaser to hang the replaceable inner pliant liquid bladder 20 on a grocery cart.

As shown in FIG. 1, the bottom of the replaceable inner pliant liquid bladder 20 may be substantially V-shaped.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A replaceable liquid container for use with an outer substantially rigid hollow housing wherein the outer substantially rigid hollow housing includes an upper neck having an opening formed therein and a cap to selectively seal the opening, said replaceable liquid container comprises a closed flexible enclosure including a reduced upper end having an upper mounting portion to secure said replaceable liquid container to the outer rigid hollow housing and an intermediate portion to be disposed within the upper neck between said upper mounting portion and a lower bladder to retain liquid therein, said upper mounting portion selectively movable from an extended position to an inverted position relative to said intermediate portion and said lower bladder and the upper neck such that when said lower bladder is positioned within the outer substantially rigid hollow housing and said intermediate portion disposed within the upper neck and said upper mounting portion is secured to the upper neck by moving said upper mounting portion from said extended position to said inverted position in surrounding relationship relative to the upper neck with said reduced upper end in said inverted position pressed between the cap and the upper neck and further including an installation means coupled thereto to facilitate the installation and placement of said replaceable liquid container in the outer substantially rigid hollow housing, said installation means comprises an elongated substantially rigid member coupled to said upper mounting portion.

2. The replaceable liquid container of claim 1 further including a secondary bladder to retain the liquid disposed within said lower bladder portion.

3. The replaceable liquid container of claim 1, wherein said upper mounting portion comprises a flexible open cone-shaped upper end.

4. The replaceable liquid container of claim 1 wherein said upper mounting portion comprises a flexible upper end including a first and second barrier cooperatively forming a liquid isolation chamber therebetween.

5. The replaceable liquid container of claim 1 Wherein said upper mounting portion comprises a flexible closed funnel shaped upper end.

6. The replaceable liquid container of claim 1 further including an attachment means to mount said replaceable liquid container to a support before use.

7. The replaceable liquid container of claim 1 wherein said attachment means comprises a draw string coupled to said upper mounting portion.

8. The replaceable liquid container of claim 6 wherein said attachment means comprises a hook coupled to said replaceable liquid container.

9. The replaceable liquid container of claim 1 wherein the bottom of the replaceable liquid container is substantially V-shaped.

10. A replaceable liquid container for use with an outer substantially rigid hollow housing wherein the outer substantially rigid hollow housing includes an upper neck having an opening formed therein and a cap to selectively seal the opening, said replaceable liquid container comprises a closed flexible enclosure including a reduced upper end having an upper mounting portion to secure said replaceable liquid container to the outer rigid hollow housing and an intermediate portion to be disposed within the upper neck between said upper mounting portion and a lower bladder to retain liquid therein, said upper mounting portion selectively movable from an extended position to an inverted position relative to said intermediate portion and said lower bladder and the upper neck such that when said lower bladder is positioned within the outer substantially rigid hollow housing and said intermediate portion disposed within the upper neck and said upper mounting portion is secured to the upper neck by moving said upper mounting portion from said extended position to said inverted position in surrounding relationship relative to the upper neck with said reduced upper end in said inverted position pressed between the cap and the upper neck, said replaceable liquid container is perforated to permit separation of the upper end of said upper mounting portion from said lower bladder portion when installed in the outer rigid hollow housing.

11. The replaceable liquid container of claim 10 further including a secondary bladder to retain the liquid disposed within said lower bladder portion.

12. The replaceable liquid container of claim 10 wherein said upper mounting portion comprises a flexible open cone-shaped upper end.

13. The replaceable liquid container of claim 10 wherein said upper mounting portion comprises a flexible upper end including a first and second barrier cooperatively forming a liquid isolation chamber therebetween.

14. The replaceable liquid container of claim 10 wherein said upper mounting portion comprises a flexible closed funnel shaped upper end.

15. The replaceable liquid container of claim 10 further including an attachment means to mount said replaceable liquid container to a support before use.

16. The replaceable liquid container of claim 15 wherein said attachment means comprises a draw string coupled to said upper mounting portion.

17. The replaceable liquid container of claim 15 wherein said attachment means comprises a hook coupled to said replaceable liquid container.

18. The replaceable liquid container of claim 10 wherein the bottom of the replaceable liquid container is substantially V-shaped.

* * * * *